US008015966B2

(12) United States Patent
Fontaine et al.

(10) Patent No.: US 8,015,966 B2
(45) Date of Patent: Sep. 13, 2011

(54) OIL CIRCULATING DEVICE FOR INTERNAL COMBUSTION ENGINE

(76) Inventors: Steeve Fontaine, Le Port Marly (FR); Dominique Boulbin, Ollainville (FR)

( * ) Notice: Subject to any disclaimer, the term of this patent is extended or adjusted under 35 U.S.C. 154(b) by 758 days.

(21) Appl. No.: 11/908,030

(22) PCT Filed: Feb. 15, 2006

(86) PCT No.: PCT/FR2006/050138

§ 371 (c)(1),
(2), (4) Date: Jun. 16, 2008

(87) PCT Pub. No.: WO2006/095104

PCT Pub. Date: Sep. 14, 2006

(65) Prior Publication Data

US 2009/0211851 A1 Aug. 27, 2009

(30) Foreign Application Priority Data

Mar. 7, 2005 (FR) ..... 05 02267

(51) Int. Cl.
*F01M 13/04* (2006.01)

(52) U.S. Cl. ..... 123/572; 123/196 R

(58) Field of Classification Search ..... 123/572–574, 123/41.86, 196 R

See application file for complete search history.

(56) References Cited

U.S. PATENT DOCUMENTS

| | | | | |
|---|---|---|---|---|
| 2,642,052 | A | 6/1953 | Wagner et al. | |
| 5,205,848 | A * | 4/1993 | Blanc et al. | 55/310 |
| 5,622,156 | A * | 4/1997 | Rose et al. | 123/573 |
| 5,697,350 | A * | 12/1997 | Brutsch et al. | 123/572 |
| 5,975,065 | A | 11/1999 | Clauss et al. | |
| 7,080,636 | B2 * | 7/2006 | Knaus et al. | 123/572 |

FOREIGN PATENT DOCUMENTS

JP 8 260936 10/1996

* cited by examiner

*Primary Examiner* — Marguerite McMahon
(74) *Attorney, Agent, or Firm* — Oblon, Spivak, McClelland, Maier & Neustadt, L.L.P.

(57) ABSTRACT

An oil circulating device for an internal combustion engine including a separating-decanting device, a cylinder housing, a pressurized oil feeding pipe circulating pressurized oil to mobile parts of the engine, and a siphon-forming oil return circuit. The oil return circuit includes a canula with an upper end that opens into the separating-decanting device to collect therein decanted oil and a lower end immersed in an oil tank opening freely into a plane located between the upper and lower ends of the canula. The tank includes an insert tightly inserted in a passageway formed through a wall of the pressurized oil feeding pipe, the insert forming simultaneously a closure plug for the oil feeding pipe and for an oil tank.

10 Claims, 2 Drawing Sheets

A-A

A-A

OIL CIRCULATING DEVICE FOR INTERNAL COMBUSTION ENGINE

The present invention relates generally to a device making it possible to prevent oil from returning into an oil outlet formed in an oil separator/decanter device of an internal combustion engine.

More particularly, the invention relates to an oil circulation device for an internal combustion engine comprising a separator/decanter device suitable for extracting oil contained in an oil/gas mixture, a cylinder housing in which at least one combustion chamber is formed, the device also comprising a pressurized oil supply duct suitable for carrying pressurized oil to the movable portions of said engine and an oil return circuit forming a siphon, the oil return circuit comprising at least one canula of which a top end opens into an oil outlet of said separator/decanter device in order to collect decanted oil therein and of which a bottom end is immersed in an oil reservoir having an aperture opening freely into a plane situated between said top end and said bottom end of the canula.

Internal combustion engines are lubricated by systems for spraying oil onto the moving parts such as the pistons, the connecting rods, the crankshaft and the camshafts. Ventilation gases consisting of an air/oil mixture usually pass through an oil separator/decanter device in order to prevent a risk of a throwback of air containing oil particles.

The oil is deposited on a decantation surface formed in the separator/decanter device by a series of chicanes allowing the mixture to follow by gravity a relatively long path along which the air and the oil separate.

The oil thus extracted and decanted comes out of the decanter through an oil outlet. In order to prevent the oil/air mixture returning to the decanter via its outlet, siphons are used.

This is why many engine manufacturers have developed various solutions aimed at preventing returns of oil into the separator/decanter device while seeking at the same time to reduce the size of the engine and the number of parts necessary to manufacture the engine oil circulation device.

A device of the type defined above providing such advantages is for example described in patent document FR 2 819 291.

In this context, the object of the present invention is to optimize the manufacture of such an oil circulation device in the case of engines having a pressurized oil supply duct.

For this purpose, the oil circulation device of the invention, furthermore complying with the generic definition given to it by the preamble defined above, is essentially characterized in that said reservoir is made in an insert inserted in a sealed manner into a passageway formed through a wall of said pressurized oil supply duct, the insert simultaneously forming a plug to close off said oil supply duct and an oil reservoir.

The presence of this reservoir makes it possible to prevent the return of oil through the separator/decanter device outlet and thereby makes it possible to maximize the oil separation/decantation function. In addition, thanks to the invention, said pressurized oil supply duct is used as a support of the oil reservoir which avoids having to position a support specifically dedicated to the retention of the reservoir and which also allows a space-saving in total height of the engine since the oil reservoir is partly positioned in the thickness of the wall of said oil supply duct.

The height difference that exists between the threshold of the decantation surface of the separator/decanter device and the bottom threshold of the siphon (this bottom threshold of the siphon consisting of the bottom end of the canula) allows a pressure balancing in order to prevent the return of an oil/gas mixture in the location of the outlet of the decanter device. Thanks to the invention, this height difference can be increased while reducing the height of the engine. The length of the canula that fixes the height difference will be chosen according to the pressure differential existing between the outlet of the separator/decanter device and the enclosure into which the decanted oil is poured (usually the inside of the housing, and above the moving parts to be lubricated (for example in the crankshaft housing)).

Equally, when the pressurized oil supply duct is made by molding, which is almost always the case, it is then necessary to have an aperture in this supply duct to allow the positioning and then the withdrawal of a mold core (usually a core defining the internal shapes of the duct). Usually, after the removal of the mold core, this hole is plugged, with the aid of an insert/plug. Thanks to the invention, the oil reservoir is made in the plug of the high-pressure duct, thereby making it possible to save a part and reduce the number of machining operations.

It is possible, for example, to ensure that a portion of said pressurized oil supply duct forms an integral part of said cylinder housing and that the passageway in which the insert is positioned is formed in this portion and thereby forms part of the cylinder housing.

In this particular embodiment, the invention is applied to a cylinder housing comprising a pressurized oil supply duct. This embodiment may be applied to a large number of engines and particularly to V-engines as in the example of FIGS. 1 to 3 described below.

It is also possible to ensure that the aperture of the oil reservoir opens freely into an internal zone of said cylinder housing, above a location reserved for a crankshaft.

According to a particular embodiment, said insert is swaged into the passageway formed through the wall of said supply duct.

It is also possible to ensure that the insert has the shape of a cylindrical bowl and that the bottom end of the canula is positioned in a bottom zone of said bowl.

It is also possible to ensure that the canula has a shape of a cylindrical tube and is coaxial relative to the cylindrical bowl-shaped insert.

In this embodiment, there is therefore a considerable clearance between the canula and the bowl-shaped insert, which makes it possible to have a considerable latitude of positioning of the canula relative to the insert thereby reducing the accuracies of machining and assembly necessary to produce the device of the invention.

It is also possible to ensure that a first height H1, defined by the minimum distance separating the bottom end of the canula from said aperture of the oil reservoir, is less than half of a second height H2 defined by the distance separating said bottom and top ends of the canula.

This dimensional feature is advantageous for fixing the pressure that can be balanced by the device of the invention.

For the same reason, it is also possible to ensure that the first height H1 is greater than a quarter of the second height H2.

Also, for the same reason, it is also possible to ensure that the open-ended aperture of said oil reservoir has a section greater than an oil passageway cross section in the canula.

Ideally, it is possible to ensure that the device is suitable for being installed in an engine with several cylinders and that it comprises several independent canulas and several independent oil reservoirs and that the separator/decanter device has several independent outlets of decanted oil, each independent canula being connected to an independent oil outlet of said separator/decanter device and immersed in an independent oil reservoir, and that each independent oil reservoir is an independent insert inserted into a corresponding passageway formed through the wall of said pressurized oil supply duct, each independent insert therefore simultaneously forming a plug for closing off said oil supply duct and an oil reservoir.

Other features and advantages of the invention will clearly emerge from the description made thereof below, as an indication and in no way limiting, with reference to the appended drawings in which.

Figure 1:
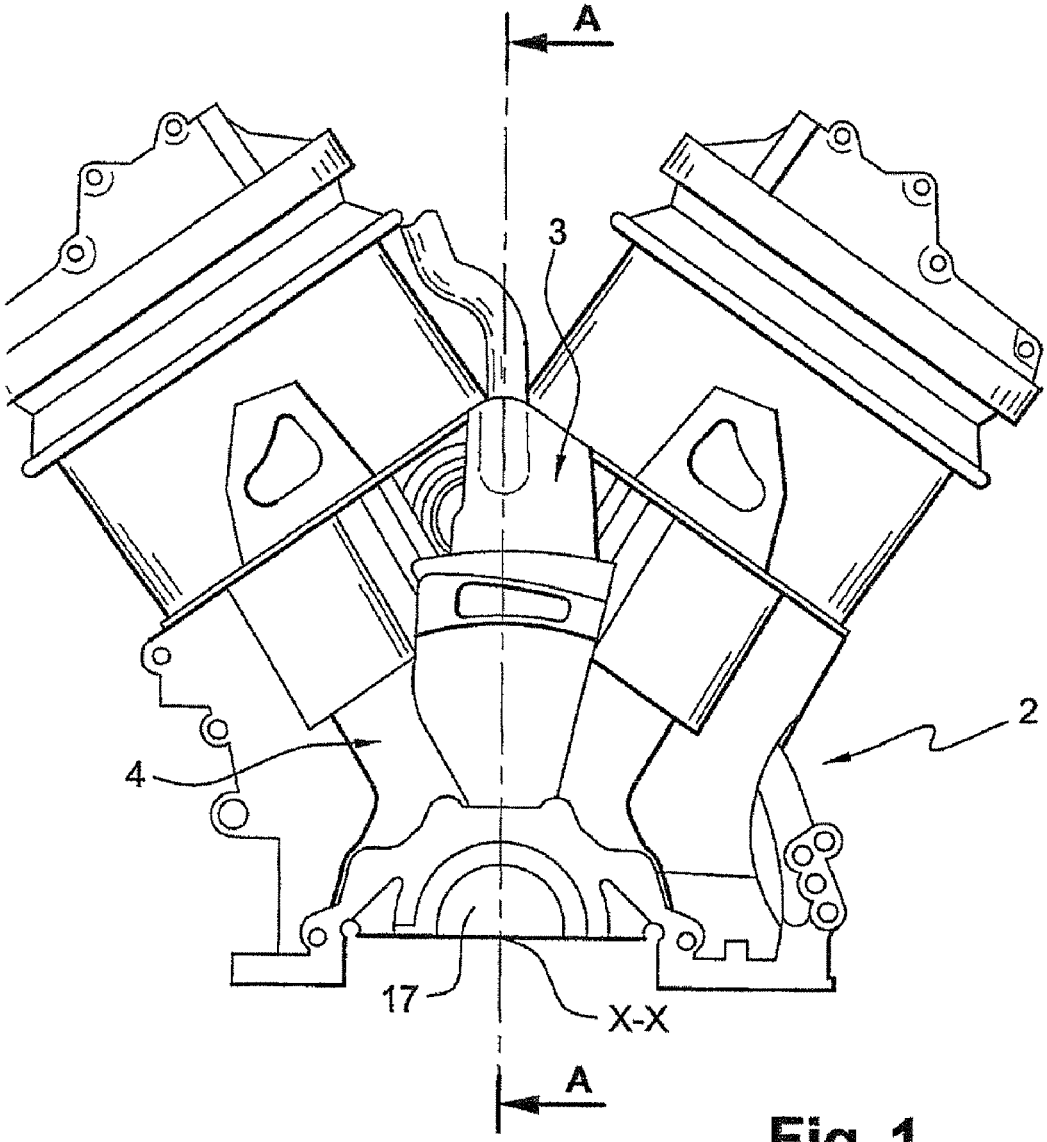
FIG. 1 represents a view of a V-engine fitted with the device of the invention.

As announced above, the invention relates to an oil circulation device 1 incorporated into an internal combustion engine which in this instance is a V-engine. The V-engine of FIG. 1 comprises two rows of combustion chambers, distributed on either side of an axis A-A. Each row of combustion chambers comprises three chambers positioned in one and the same plane.

A decanter device 3 is positioned in the plane of symmetry of the engine and above an axis X-X that is the axis of rotation of the crankshaft. The location 17 reserved for the crankshaft is placed beneath the decanter/separator device so that the decanted and separated oil flows over the crankshaft and returns to the oil sump of the bottom housing.

Figure 2:
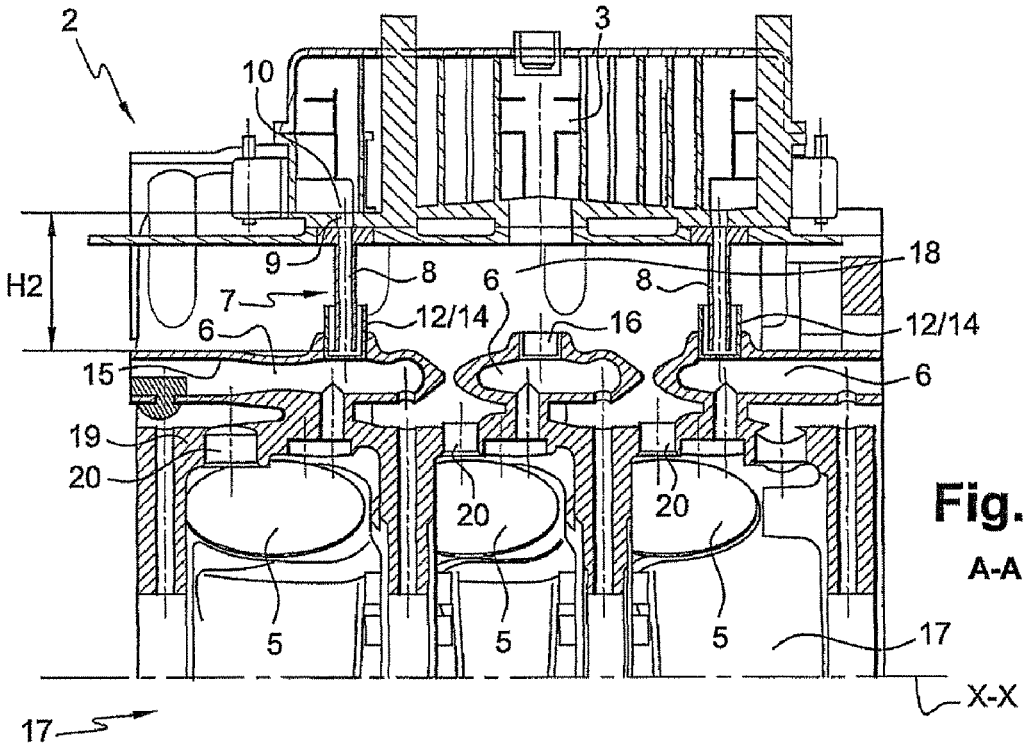
FIG. 2 represents a view in section of the V-engine along an axis A-A.

FIG. 2 is a view in section in a plane of the engine comprising the axis A-A and the axis of rotation of the crankshaft X-X. Three cylinders 5 are partially visible and form the locations in which the pistons must be inserted. These cylinders are formed in the engine housing that is a part molded in a single block. A pressurized oil supply duct 6 is placed in the cylinder housing, between the separator/decanter device 3 and the location 17 reserved for the crankshaft. This duct 6 is suitable for being connected to an oil pump and comprises a pressurized oil outlet pointing in the direction of the location 17.

This duct 6 forms part of the cylinder housing 4 that is a monobloc part made by molding.

A de-oiling zone 18 is formed in the cylinder housing above the pressurized oil supply duct 6 and below the separator/decanter device. The fact that the pressurized oil supply duct is interposed between the separator/decanter device and the location 17 reserved for the crankshaft makes it possible to protect the de-oiling zone from the direct oil splashes originating from the crankshaft which allows the oil passing into the de-oiling zone to flow on the pressurized oil supply duct.

The pressurized oil supply duct has an enlarged external shape forming a deflector 19. This deflector has oil flow zones, suitable for conducting, by gravity, the oil flowing from the de-oiling zone 18 on the deflector 19 of the duct 6 to local perforations 20 of the deflector 19.

The separator/decanter device 3 is a chamber having an entrance opening into the de-oiling zone 18 in order to collect therein an oil/gas mixture to be separated. The inside of the separator/decanter device 3 is formed of a multitude of chicanes created so that the oil/gas mixture passes via a long path zigzagging from one chicane to the next. In this way the oil that comes into contact with a chicane falls by gravity to the bottom of the separator/decanter device and the de-oiled gases may be discharged toward the outside of the engine. The oil extracted from the oil/gas mixture is discharged from the separator/decanter device 3 via an oil outlet 10 of the separator/decanter device supplying an oil return circuit 7.

The oil return circuit forms a siphon in order to prevent the oil/gas mixture entering the separator exchanger device via its outlet 10.

This oil return circuit 7 comprises a canula 8 whose top end 9 is connected to the oil outlet of said separator/exchanger device 3 and of which a bottom end 11 is immersed in a reservoir 12. This reservoir 12 is formed by a bowl-shaped insert 14 in which the top portion of the bowl is open toward the inside of the cylinder housing, in the de-oiling zone 18. The aperture of the bowl is in a plane P and has the shape of a disk peripheral to the canula, this disk being in the plane P and placed at a distance H1 from the bottom end of the canula. The bottom of the bowl is inserted into a passageway formed through the wall 15 of the oil supply circuit and therefore forms a plug of the pressurized oil supply duct.

The second end of the canula is situated much closer to the bottom of the bowl-shaped insert than the top edges of this bowl.

The top edges of this bowl delimit said aperture of the reservoir, the section of this aperture being reduced from the section occupied by the whole of the canula.

Actually, the top edges of the bowl-shaped insert are in a horizontal plane allowing the oil to flow over the whole periphery of the bowl when the latter overflows.

In this manner, a hole or passageway formed through the wall 15 of the oil supply duct in order to allow the machining of shapes inside the duct also makes it possible to receive an insert once the inside of the duct 6 has been machined. The deeper the bowl, the longer the canula can be. The length of the canula necessary to prevent the return of an oil/gas mixture is therefore great without having to increase the height of the engine. The back-pressure inside the de-oiling zone may therefore be greater if necessary, without for all that there being a need to increase the height of the engine and without there being a risk of the de-oiler being polluted by the return of oil/gas mixture.

Thanks to this advantage, the engine may therefore have enhanced performance.

Figure 3:
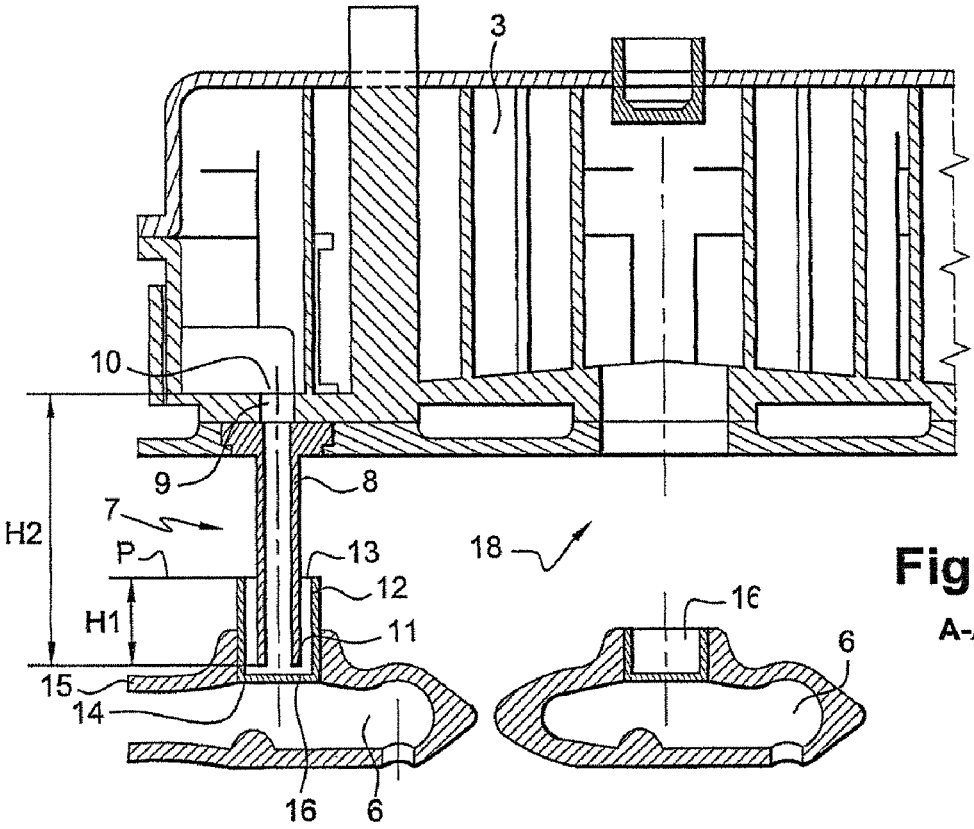
FIG. 3 represents an enlarged view of a portion of FIG. 2.

FIG. 3 represents a detailed view of a portion of FIG. 2. A first height H1 determines the length of the portion of canula 8 that is immersed in the oil reservoir 12 (the distance between the bottom end 11 of the canula and the top of the reservoir). A second height H2 determines the length of the canula (the distance between the ends of the canula). The greater the difference in height between H1 and H2, the greater must be the back-pressure in the de-oiling zone capable of producing a return of oil/gas mixture into the separator/decanter device. The height H1 must be sufficient for the volume of oil situated above the bottom end of the canula and contained in the receptacle to be able to fill a height of canula determined according to the maximum back-pressure admissible by the engine (the back-pressure is the difference in pressure between the pressure inside the decanter device, at its outlet 10, and the pressure inside the de-oiling zone 18).

The invention claimed is:

1. An oil circulation device for an internal combustion engine comprising:

a separator/decanter device configured to extract oil contained in an oil/gas mixture;

a cylinder housing in which at least one combustion chamber is formed;

a pressurized oil supply duct configured to carry pressurized oil to movable portions of the engine; and an oil return circuit forming a siphon, the oil return circuit comprising at least one canula having a top end that opens into an oil outlet of the separator/decanter device to collect decanted oil therein and a bottom end that is immersed in an oil reservoir having an aperture opening freely into a plane situated between the top end and the bottom end of the canula, wherein the reservoir is made in an insert inserted in a sealed manner into a passageway formed through a wall of the pressurized oil supply duct, the insert simultaneously forming a plug to close off the oil supply duct and an oil reservoir.

2. The device as claimed in claim 1, wherein a portion of the pressurized oil supply duct forms an integral part of the cylinder housing, and the passageway in which the insert is positioned is formed in this portion and thereby forms part of the cylinder housing.

3. The device as claimed in claim 1, wherein the aperture of the oil reservoir opens freely into an internal zone of the cylinder housing, above a location reserved for a crankshaft.

4. The device as claimed in claim 1, wherein the insert is swaged into the passageway formed through the wall of the supply duct.

5. The device as claimed in claim 1, wherein the insert has a shape of a cylindrical bowl, and the bottom end of the canula is positioned in a bottom zone of the bowl.

6. The device as claimed in claim 5, wherein the canula has a shape of a cylindrical tube and is coaxial relative to the cylindrical bowl-shaped insert.

7. The device as claimed in claim 1, wherein a first height, defined by the minimum distance separating the bottom end of the canula from the aperture of the oil reservoir, is less than half of a second height defined by the distance separating the bottom and top ends of the canula.

8. The device as claimed in claim 7, wherein the first height is greater than a quarter of the second height.

9. The device as claimed in claim 1, wherein the open-ended aperture of the oil reservoir has a section greater than an oil passageway cross section in the canula.

10. The device as claimed in claim 1, configured to be installed in an engine with plural cylinders, and further comprising plural independent canulas and plural independent oil reservoirs, and wherein the separator/decanter device includes plural independent outlets of decanted oil, each independent canula being connected to an independent oil outlet of the separator/decanter device and immersed in an independent oil reservoir, and wherein each independent oil reservoir is an independent insert inserted into a corresponding passageway formed through the wall of the pressurized oil supply duct, each independent insert simultaneously forming a plug for closing off the oil supply duct and an oil reservoir.

* * * * *